US006347761B1

(12) United States Patent
Larson

(10) Patent No.: US 6,347,761 B1
(45) Date of Patent: Feb. 19, 2002

(54) MOBILE CABLE DISPENSING SYSTEM

(76) Inventor: Rick E. Larson, 579 Sioux St. South, Iroquois, SD (US) 57353

( * ) Notice: Subject to any disclaimer, the term of this patent is extended or adjusted under 35 U.S.C. 154(b) by 2 days.

(21) Appl. No.: 09/627,715

(22) Filed: Jul. 28, 2000

(51) Int. Cl.[7] ..... B65H 75/48

(52) U.S. Cl. ..... 242/390.5; 242/393; 242/397.3; 242/559.4

(58) Field of Search ..... 242/390.2, 390.5, 242/390.6, 397.3, 393, 399.1, 399.2, 403, 559.4

(56) References Cited

U.S. PATENT DOCUMENTS

| | | | | |
|---|---|---|---|---|
| 2,679,987 | A | * | 6/1954 | Saliba |
| D181,438 | S | | 11/1957 | Petersen |
| 2,867,390 | A | * | 1/1959 | Anrig |
| D186,589 | S | | 11/1959 | Petersen |
| 3,091,413 | A | * | 5/1963 | Leithiser |
| 3,941,324 | A | * | 3/1976 | Green |
| 4,174,809 | A | * | 11/1979 | Arlemark |
| 4,583,700 | A | | 4/1986 | Tschurbanoff |
| 4,588,142 | A | | 5/1986 | Malzacher |
| 4,701,098 | A | | 10/1987 | Bills et al. |
| 4,762,291 | A | | 8/1988 | Sauber |
| 4,767,073 | A | | 8/1988 | Malzacher |
| 5,139,751 | A | * | 8/1992 | Mansfield et al. |
| 5,215,272 | A | | 6/1993 | Sauber |
| 5,332,166 | A | | 7/1994 | Kepes |
| 5,402,959 | A | | 4/1995 | Wadle |
| 5,897,073 | A | * | 4/1999 | McVaugh |

* cited by examiner

*Primary Examiner*—William A. Rivera

(57) ABSTRACT

A mobile cable dispensing system for dispensing and retrieving cable from a spool of cable. The mobile cable dispensing system includes a trailer having a top surface, a bottom surface, a front end, a back end a pair of lateral sides. A power supply is securely attached to a top surface of the trailer. An elongate pole is extendable through the spool of cable. Each of a pair of support arms has a first end and a second end. Each of the first ends is rotatably coupled to one of the lateral sides. Each of the second ends comprises a clamp adapted to removably and rotatably couple to the pole. A first actuator comprises an elongate actuator having a first end and a second end. The first actuator is adapted to selectively vary the length between the first and second ends of the first actuator. The first end of the first actuator is pivotally coupled to a first of the lateral sides. The second end of the first actuator is pivotally to a first of the support arms. The first actuator is mechanically coupled to the power supply. A driving means controls rotation of the spool. A cable guiding means guides the cable on and off of the spool. A control means controls the power supply and is operationally coupled to the power supply, the first actuators, and the driving means.

19 Claims, 13 Drawing Sheets

MOBILE CABLE DISPENSING SYSTEM

BACKGROUND OF THE INVENTION

1. Field of the Invention

The present invention relates to cable dispensing devices and more particularly pertains to a new mobile cable dispensing system for dispensing and retrieving cable from a spool of cable.

2. Description of the Prior Art

The use of cable dispensing devices is known in the prior art. More specifically, cable dispensing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,402,959; U.S. Pat. No. 5,332,116; U.S. Pat. No. 4,583,700; U.S. Pat. No. 4,588,142; U.S. Pat. No. 4,701,098; U.S. Pat. No. 4,762,291; U.S. Pat. No. 5,215,272; U.S. Pat. No. 4,767,073; U.S. Des. Pat. No. 186,589; and U.S. Pat. Des. No. 181,438.

While these devices fulfill their respective, particular objectives and requirements, the aforementioned patents do not disclose a new mobile cable dispensing system. The inventive device includes a trailer having a top surface, a bottom surface, a front end, a back end a pair of lateral sides. A power supply is securely attached to a top surface of the trailer. An elongate pole is extendable through the spool of cable. Each of a pair of support arms has a first end and a second end. Each of the first ends is rotatably coupled to one of the lateral sides. Each of the second ends comprises a clamp adapted to removably and rotatably couple to the pole. A first actuator comprises an elongate actuator having a first end and a second end. The first actuator is adapted to selectively vary the length between the first and second ends of the first actuator. The first end of the first actuator is pivotally coupled to a first of the lateral sides. The second end of the first actuator is pivotally to a first of the support arms. The first actuator is mechanically coupled to the power supply. A driving means controls rotation of the spool. A cable guiding means guides the cable on and off of the spool. A control means controls the power supply and is operationally coupled to the power supply, the first actuators, and the driving means.

In these respects, the mobile cable dispensing system according to the present invention substantially departs from the conventional concepts and designs of the prior art, and in so doing provides an apparatus primarily developed for the purpose of dispensing and retrieving cable from a spool of cable.

SUMMARY OF THE INVENTION

In view of the foregoing disadvantages inherent in the known types of cable dispensing devices now present in the prior art, the present invention provides a new mobile cable dispensing system construction wherein the same can be utilized for dispensing and retrieving cable from a spool of cable.

The general purpose of the present invention, which will be described subsequently in greater detail, is to provide a new mobile cable dispensing system apparatus and method which has many of the advantages of the cable dispensing devices mentioned heretofore and many novel features that result in a new mobile cable dispensing system which is not anticipated, rendered obvious, suggested, or even implied by any of the prior art cable dispensing devices, either alone or in any combination thereof.

To attain this, the present invention generally comprises a trailer having a top surface, a bottom surface, a front end, a back end a pair of lateral sides. A power supply is securely attached to a top surface of the trailer. An elongate pole is extendable through the spool of cable. Each of a pair of support arms has a first end and a second end. Each of the first ends is rotatably coupled to one of the lateral sides. Each of the second ends comprises a clamp adapted to removably and rotatably couple to the pole. A first actuator comprises an elongate actuator having a first end and a second end. The first actuator is adapted to selectively vary the length between the first and second ends of the first actuator. The first end of the first actuator is pivotally coupled to a first of the lateral sides. The second end of the first actuator is pivotally to a first of the support arms. The first actuator is mechanically coupled to the power supply. A driving means controls rotation of the spool. A cable guiding means guides the cable on and off of the spool. A control means controls the power supply and is operationally coupled to the power supply, the first actuators, and the driving means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mobile cable dispensing system apparatus and method which has many of the advantages of the cable dispensing devices mentioned heretofore and many novel features that result in a new mobile cable dispensing system which is not anticipated, rendered obvious, suggested, or even implied by any of the prior art cable dispensing devices, either alone or in any combination thereof.

It is another object of the present invention to provide a new mobile cable dispensing system which may be easily and efficiently manufactured and marketed.

It is a further object of the present invention to provide a new mobile cable dispensing system which is of a durable and reliable construction.

An even further object of the present invention is to provide a new mobile cable dispensing system which is susceptible of a low cost of manufacture with regard to both materials and labor, and which accordingly is then susceptible of low prices of sale to the consuming public, thereby making such mobile cable dispensing system economically available to the buying public.

Still yet another object of the present invention is to provide a new mobile cable dispensing system which provides in the apparatuses and methods of the prior art some of the advantages thereof, while simultaneously overcoming some of the disadvantages normally associated therewith.

Still another object of the present invention is to provide a new mobile cable dispensing system for dispensing and retrieving cable from a spool of cable.

Yet another object of the present invention is to provide a new mobile cable dispensing system which includes a trailer having a top surface, a bottom surface, a front end, a back end a pair of lateral sides. A power supply is securely attached to a top surface of the trailer. An elongate pole is extendable through the spool of cable. Each of a pair of support arms has a first end and a second end. Each of the first ends is rotatably coupled to one of the lateral sides. Each of the second ends comprises a clamp adapted to removably and rotatably couple to the pole. A first actuator comprises an elongate actuator having a first end and a second end. The first actuator is adapted to selectively vary the length between the first and second ends of the first actuator. The first end of the first actuator is pivotally coupled to a first of the lateral sides. The second end of the first actuator is pivotally to a first of the support arms. The first actuator is mechanically coupled to the power supply. A driving means controls rotation of the spool. A cable guiding means guides the cable on and off of the spool. A control means controls the power supply and is operationally coupled to the power supply, the first actuators, and the driving means.

Still yet another object of the present invention is to provide a new mobile cable dispensing system that FOCUSED1.

Even still another object of the present invention is to provide a new mobile cable dispensing system that FOCUSED2.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
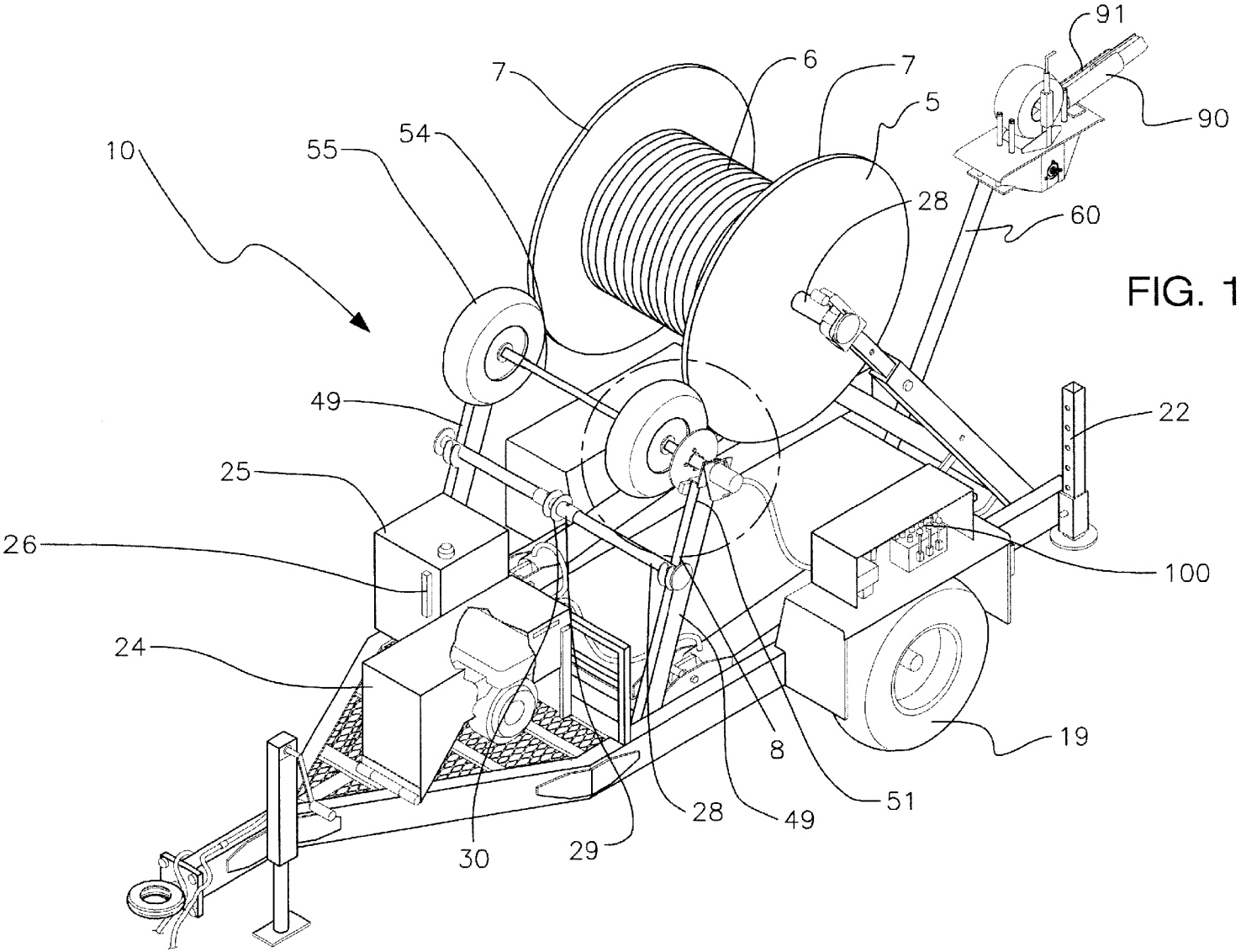
FIG. 1 is a schematic perspective view of a new mobile cable dispensing system according to the present invention.
Figure 2:
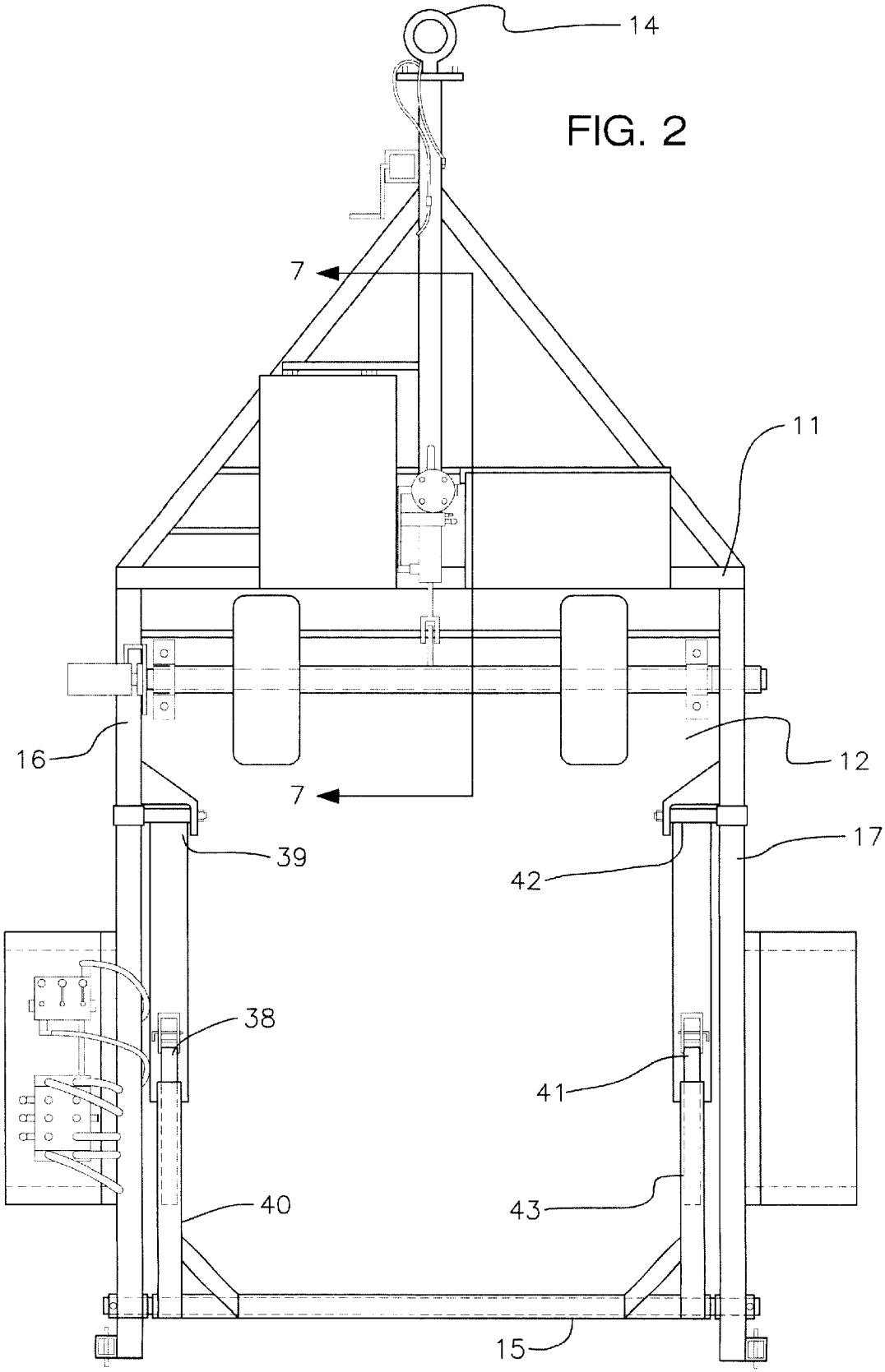
FIG. 2 is a schematic plan view of the present invention.

With reference now to the drawings, and in particular to FIGS. 1 through 13 thereof, a new mobile cable dispensing system embodying the principles and concepts of the present invention and generally designated by the reference numeral 10 will be described.

As best illustrated in FIGS. 1 through 10, the mobile cable dispensing system 10 generally comprises a trailer 11, the trailer 11 has a top surface 12, a bottom surface 13, a front end 14, a back end 15, a first lateral side 16 and a second lateral side 17. The front end 14 comprises a male hitch portion and the back end has a female hitch portion 18 coupled thereto. Each of a pair of wheels 19 is rotatably coupled to one of the lateral sides 16, 17. Each of a pair of ramps 20 is movably positioned on guide rails 21 securely attached to the bottom surface 13 of the trailer 11. The guide rails 21 are orientated generally parallel with the lateral sides 17 and are positioned generally adjacent to the back end 15. The ramps 20 allow the trailer 11 to be used as a conventional hauling-type trailer when no spool 5 is being carried.

Each of a pair of stabilizing legs 22 is coupled to a free end of one of the lateral sides 16, 17 adjacent to the back end 15 of the trailer 11. Each of the stabilizing legs 22 is selectively extendable in a vertical direction.

A power supply 24 is securely attached to the top surface 12 and positioned generally adjacent to the front end 14. The power supply 24 preferably comprises a hydraulic pump, or hydraulic motor, though an electric generator may also be used. The hydraulic pump is fluidly coupled to a tank 25 adapted for holding oil. The tank 25 is located generally adjacent to the power supply and is securely attached to the top surface 12. The tank 25 has a gauge 26 thereon incorporating a temperature gauge and a volume gauge. A separate tank 25 is desirable because the motor, or power supply 24, tends to overheat and a larger amount of oil helps to cool the motor while the miles of cable 6 are unwound from a spool 5.

An elongate pole 28 is used for extending through the spool 5. The spool 5 has a middle portion and a pair of outer discs 7.

Each of a pair of securing members 29 comprises a cylinder movably positionable on the elongate pole. Each of the cylinders has a wall 30 integrally coupled thereto and radially extending away therefrom for placement against the spool. Each of the securing members 29 is selectively securable to the elongate pole 28 by way of a fastening means, such as a bolt extending through the cylinder. The pole 28 is extended through the spool 5 and each of the securing members 29 is secured to the pole on an opposite side of the spool to keep the spool centered on the pole 28.

Figure 12:
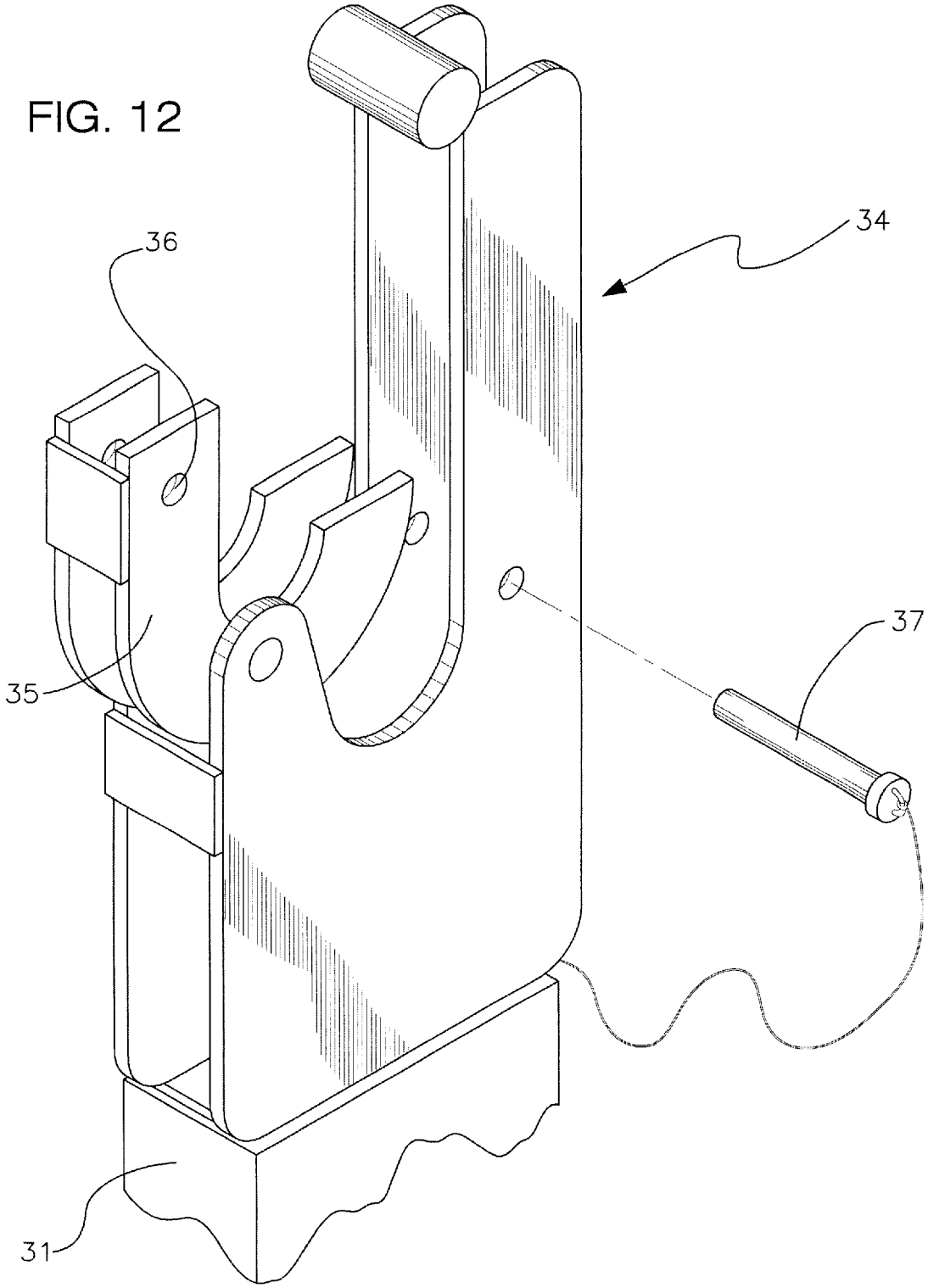
FIG. 12 is a schematic perspective view of the clamp of the present invention.
Figure 13:
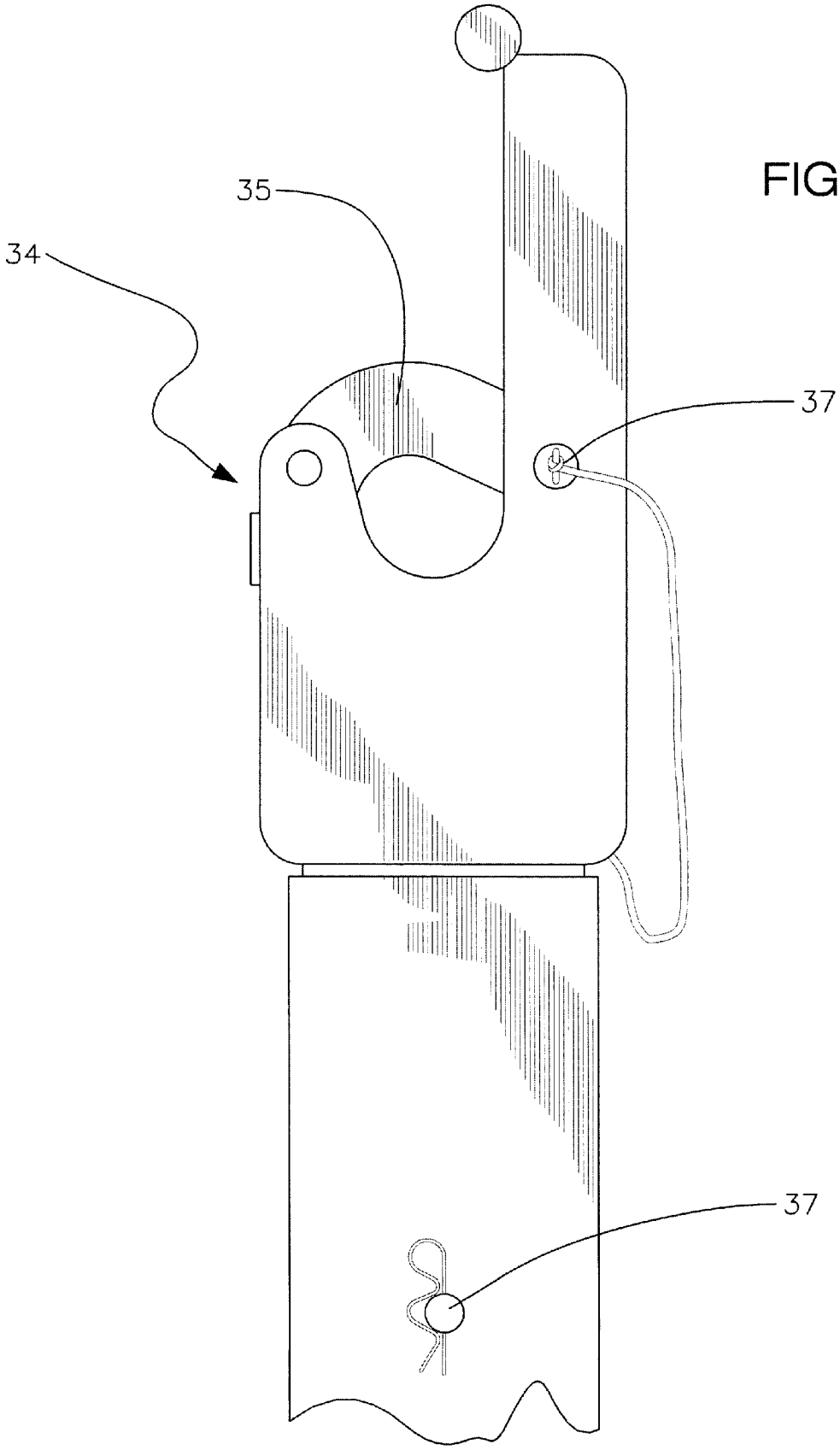
FIG. 13 is a schematic side view of the clamp of the present invention.

Each of pair of support arms 31 has a first end 32 and a second end 33. Each of the first ends 32 is rotatably coupled to one of the lateral sides 16, 17 and positioned generally adjacent to the back end 15. Each of the second ends 33 comprises a clamp 34. Each of the clamps 34 is adapted to removably couple to the pole such that the pole 28 is rotatably coupled to each of the support arms 31. As depicted in FIGS. 12 and 13, a jaw 35 is used to swing over the pole 28. The jaw 35 has a pair of bores 36 for receiving a pin 37 to selective secure the jaw 35 in a closed position. The jaw-type design helps prevent the unwanted removal of the pole 28 if the pin 37 is not in place. Each of the support arms 31 is telescoping arms such that a length between the first and second ends of each of the arms may be selectively varied. A pin is used to secure the arms in at a desired length.

A first actuator 38 comprises an elongate actuator having a first end 39 and a second end 40. The first actuator 38 is adapted to selectively vary the length between the first 39 and second 40 ends of the first actuator 38. The first end 39 of the first actuator 38 is pivotally coupled to the first lateral side 16 and positioned generally between the front 14 and back 15 ends. The second end 40 of the first actuator 38 is pivotally coupled to a first of the support arms 31 pivotally coupled to the first lateral side 16. The first actuator 38 is mechanically coupled to the power supply 24. The first actuator 38 preferably comprises a hydraulic actuator.

A second actuator 41 comprises an elongate actuator having a first end 42 and a second end 43. The second actuator 41 is adapted to selectively vary the length between the first 42 and second 43 ends of the second actuator 41. The first end 42 of the second actuator is pivotally coupled to the second lateral side 17 and positioned generally between the front and back ends. The second end 43 of the second actuator is pivotally to a second of the support arms 31 pivotally coupled to the second lateral side 17. The second actuator 41 is mechanically coupled to the power supply 24. The second actuator 41 preferably comprises a hydraulic actuator. Ideally, the actuators 38, 41 comprise a hydraulic piston and rod.

A driving means controls rotation of the spool 5. The driving means includes a first axle 44. The first axle 44 extends between and is rotatably coupled to the lateral sides 16, 17. The first axle 44 is positioned generally between the front end 14 and the support arms 31. An actuating member 45 comprises an elongate actuator having a first end 46 and a second end 47. The actuating member 45 is adapted to selectively vary the length between the first 46 and second 47 ends of the actuating member 45. The first end 46 of the actuating member 45 is pivotally coupled to the top surface 12 of the trailer 11. The second end 47 of the actuating member is pivotally coupled to an upright member 48 integrally coupled to the first axle 44. The actuating member 45 is mechanically coupled to the power supply 24.

Each of a pair of the bars 49 is elongate and has a first end 50 and a second end 51. The first ends 50 are integrally coupled to the first axle 44 and extend away from the axle 44 in a parallel direction. Each of the bars 49 is located generally adjacent to one of the lateral sides 16, 17. A protruding member 52 is integrally coupled to a first of the bars 49 and is positioned generally adjacent to the second end 51 of the first arm. The protruding member 52 has a hole 53 extending therein. A second axle 54 extends between and is rotatably coupled to the second ends 51 of the bars 49. A pair of wheels 55 is each removably mounted on the second axle 54 and is positioned between the bars 49. The wheels 55 are adapted to be positioned anywhere along the length of the second axle 54 to accommodate varying sized spools 5.

A disc portion 56 is securely mounted on the second axle 54 such that the second axle 54 extends through an axis of the disc portion 56. The disc portion 56 is located generally adjacent to the first bar. A braking means 57 frictionally engages the disc portion and is securely coupled to the first of the bar 49. The braking means 57 is mechanically coupled to the power supply 24 and preferably comprises a hydraulic brake.

A motor 58 is securely coupled to a plate 59. The plate 59 has a rod 52 extending therefrom. The rod 80 is removably extendable in the protruding member 52. The plate 59 has a hole 81 therethrough for removably receiving an end of the second axle 54. The motor 58 is adapted to rotate the second axle 54. The motor 58 is mechanically coupled to the power supply 24. The motor 58 preferably comprises a hydraulic motor adapted for selectively rotating the second axle forward or backward, though an electric motor may be used as well.

A cable guiding means guides the cable 6 on and off of the spool 5. The cable guiding means includes an elongate member 60. The elongate member 60 has a first end 61 and a second end 62. The elongate member 60 has a bend 63 therein located generally adjacent to the first end 61. The bend 63 ideally defines an angle generally between 135 degrees and 170 degrees.

A mounting member 64 receives the first end 61 of the elongate member 60. The mounting member 64 is coupled to and extends upwardly from the back end 15 of the trailer 11. The mounting member 60 has a well extending therein. The first end 61 of the elongate member 60 is extendable into the well such that the elongate member 60 is rotatable with respect to the trailer portion 11.

A panel 65, which is substantially rigid, has a top side 66, a bottom side 67, a distal portion 68, a middle portion 69 and a proximal portion 70. The second end 62 of the elongate member 60 is removably coupled to the bottom side 67 of the distal portion 68 of the panel 65. The panel 65 has a slot 71 therethrough positioned in a middle portion 69 of the panel.

A pair of walls 72 extends downwardly from and is integrally coupled to the bottom side 67 of the panel 65. Each of the walls 72 is positioned on an opposite side of the slot 71. An arm 73 extends between and is rotatably coupled to the walls 72. The arm 73 extends through and is securely attached to a first tire portion 74 such that a perimeter of the first tire portion extends upwardly through the slot 71. One of the walls 72 has a hole 75 therethrough for receiving the rod 80 coupled to the plate 59 such that the motor 58 may engage the arm 73.

A vertically extending implement 76 is integrally coupled and extends upwardly from the top side 66 of the panel 65. A bracket 77 is movably positioned on the vertically extending implement 76. A second tire portion 78 is rotatably coupled to the bracket 77 such that the second tire 78 may be selectively positioned nearer or further away from the panel 65. The bracket 77 is selectively securable in a vertical direction to place a desired distance between the first 74 and second 78 tire portions.

A pair of guide members 79 guide the cable 6 between the first 74 and second 78 tire portions. Each of the guide members 79 is positioned on opposite sides of the second tire portion 78. Each of the guide members 79 comprises a pair of upstanding members.

A cylinder 90 is securely attached to the top side 66 of the proximal portion 70 and extends away therefrom. The cylinder 90 has a pair of ends. The cylinder 90 has a peripheral wall having a slit 91 therein. The slit 91 extending between the ends of the cylinder.

An extension member 94 comprises an outer sleeve 95 and an inner sleeve 96. The inner sleeve 95 is positioned in the outer sleeve 96. Each of the sleeves are substantially rigid. Each of the sleeves has a generally cylindrical shape. The inner sleeve 95 is rotatable with respect to the outer sleeve 95. Each of the sleeves has an elongate slit 97 extending between their respective ends. The extension member 94 is positionable in the cylinder 90.

A control means 100 controls the power supply 24. The control means 100 is operationally coupled to the power supply 24, the first 38 and second 41 actuators, the actuating member 45, the breaking means 57 and the motor 58. The control means is securely attached to the trailer. The control means 100 comprises conventional controls.

Figure 3:
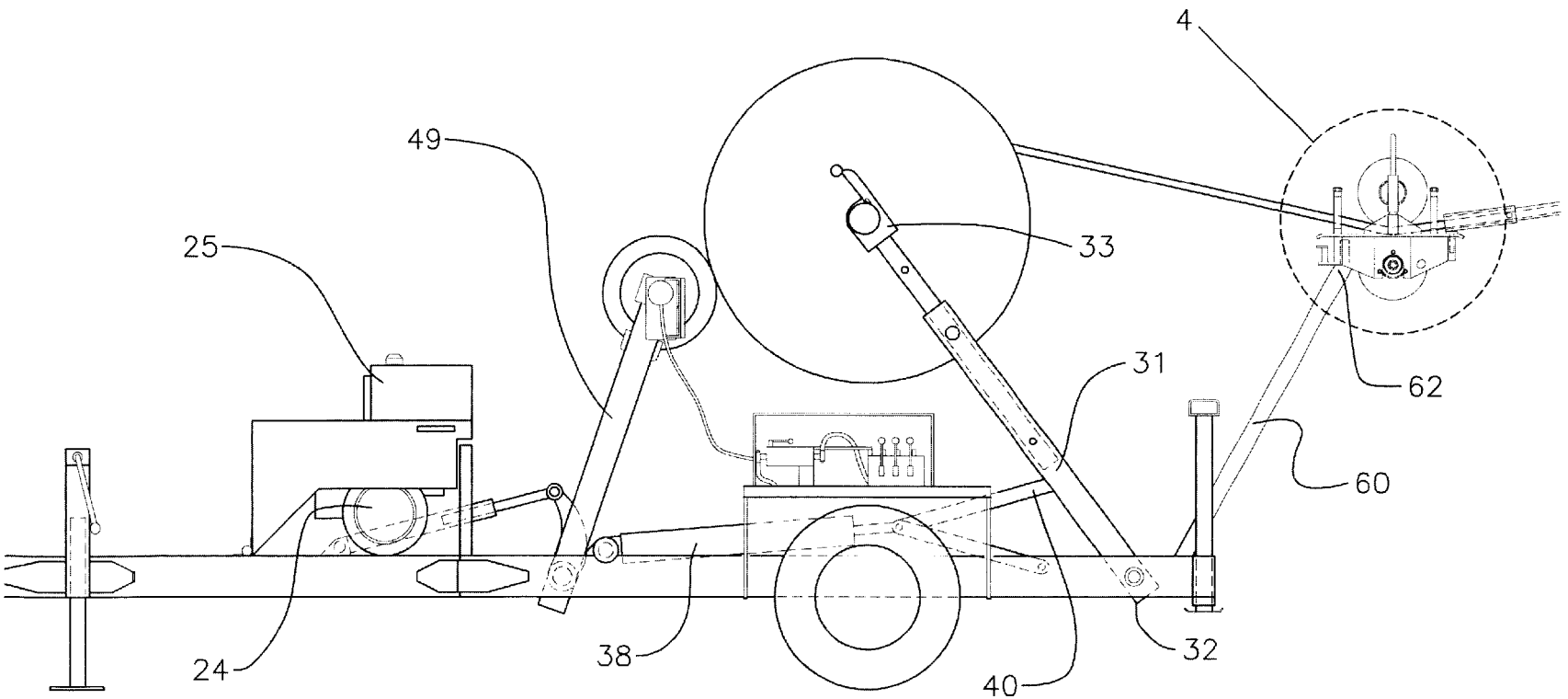
FIG. 3 is a schematic side view of the present invention.
Figure 4:
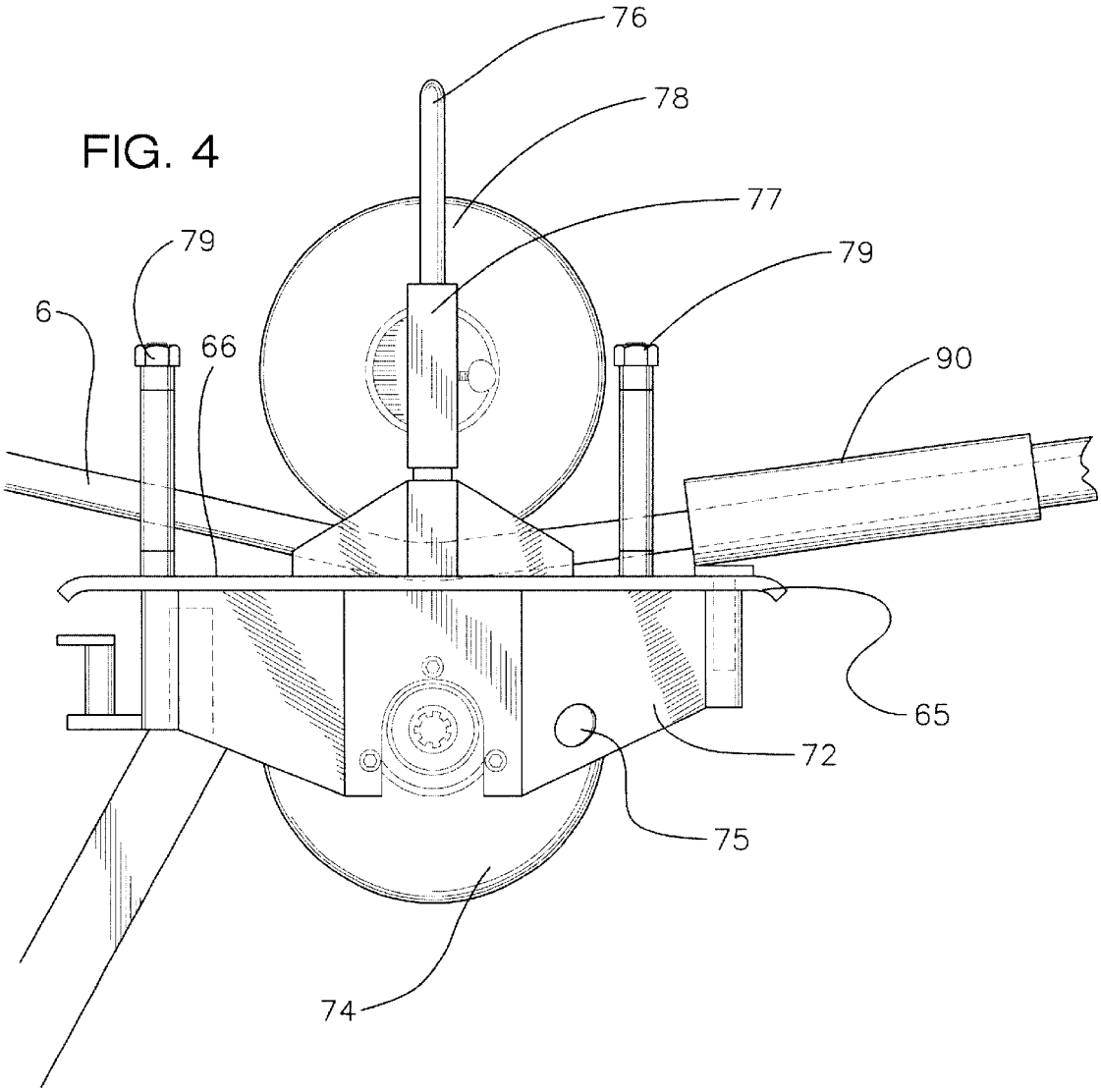
FIG. 4 is a schematic side view of the tire portions of the cable guiding means of the present invention.
Figure 5:
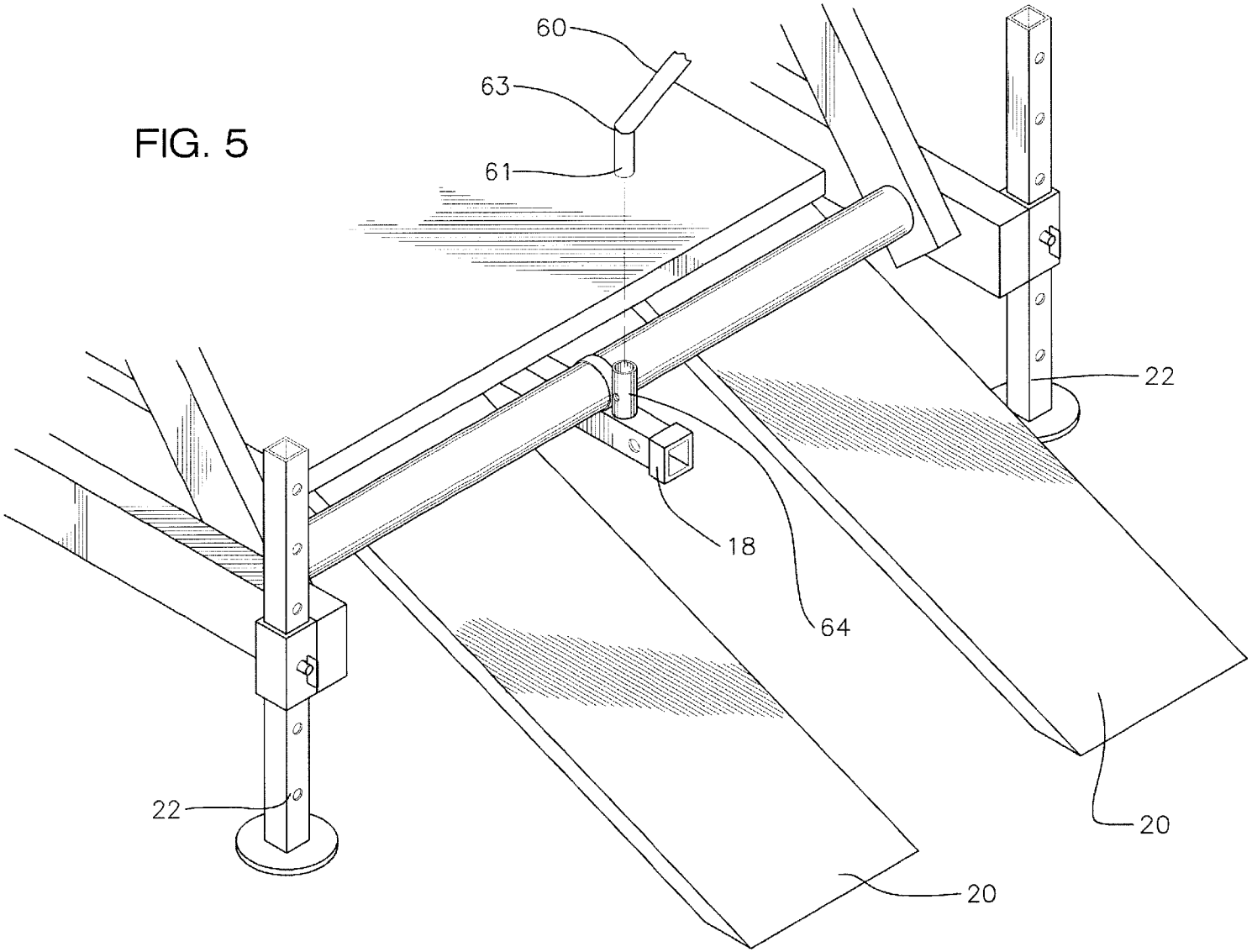
FIG. 5 is a schematic perspective view of the back end of the trailer of the present invention.
Figure 6:
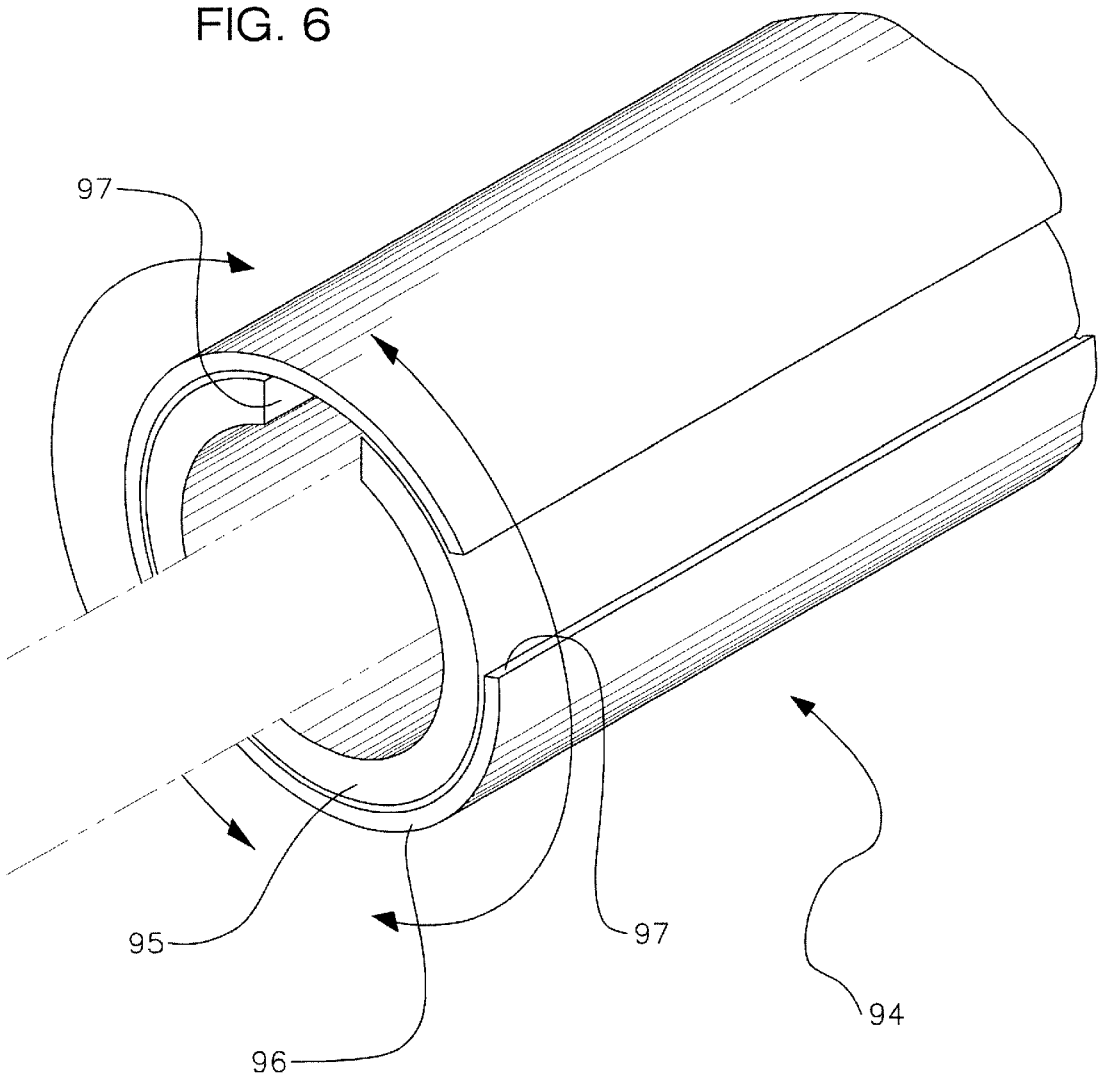
FIG. 6 is a schematic perspective view of the extension member of the cable guiding means of the present invention.
Figure 7:
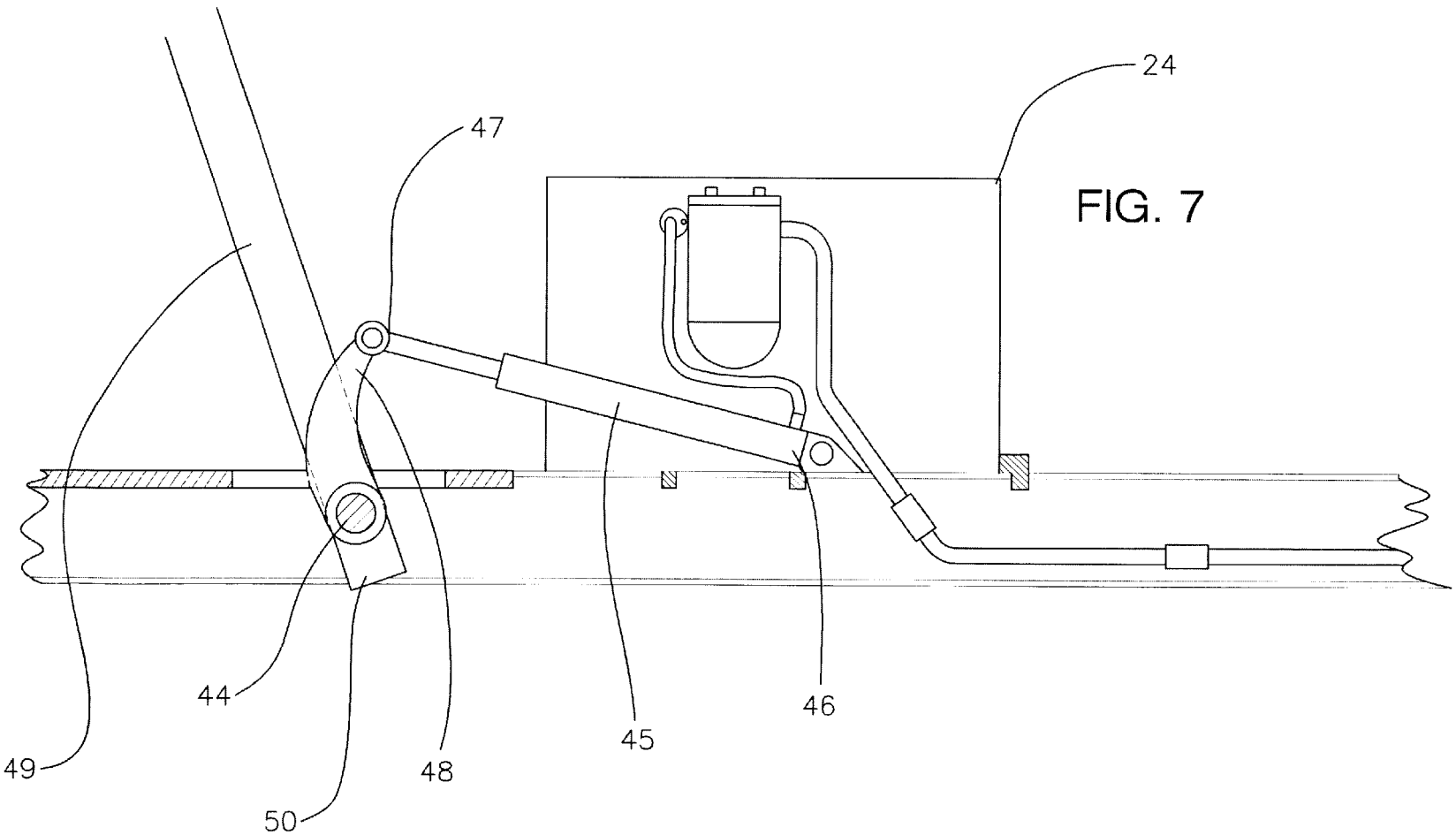
FIG. 7 is a schematic side view of the power supply of the present invention.
Figure 8:
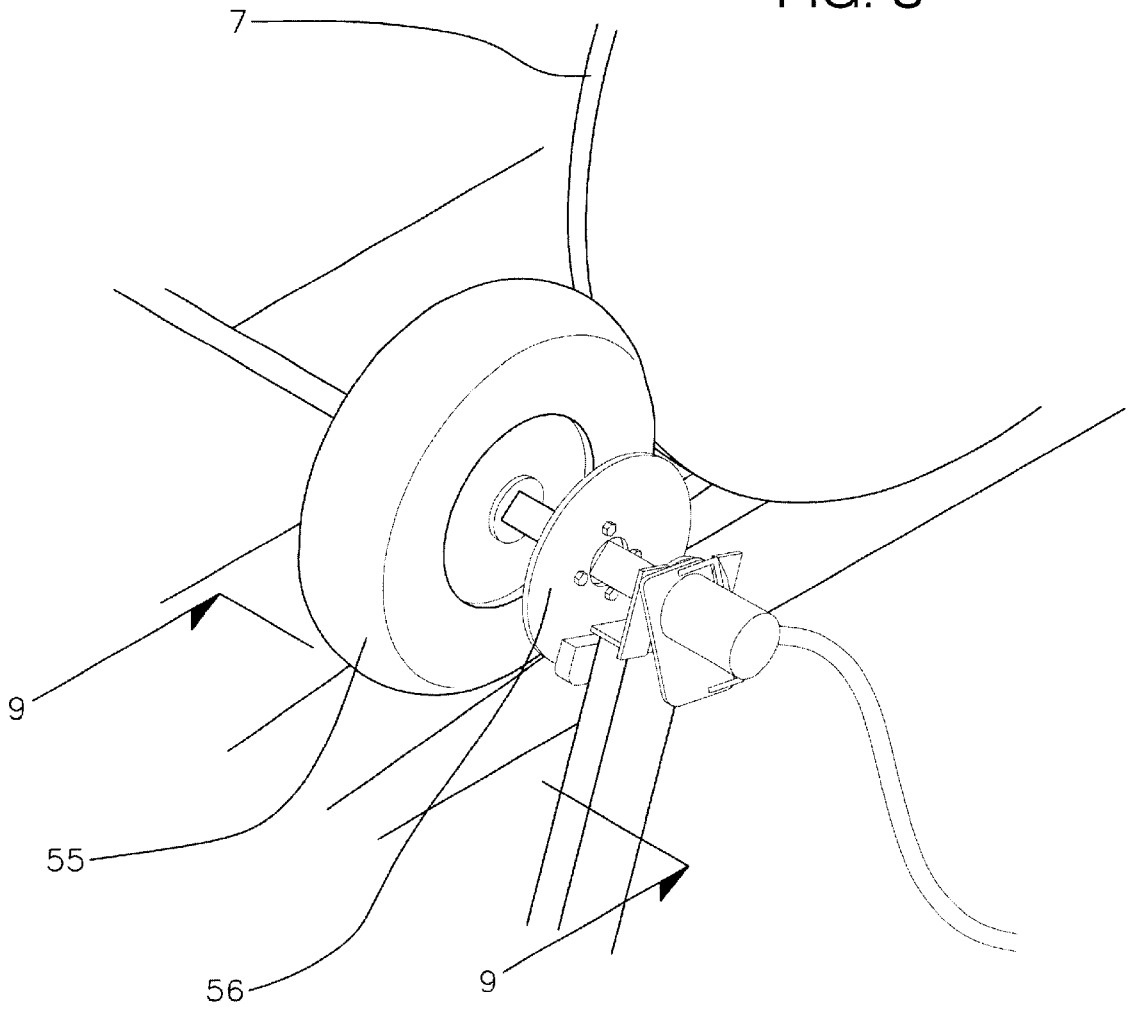
FIG. 8 is a schematic perspective view of the breaking means of the present invention.
Figure 9:
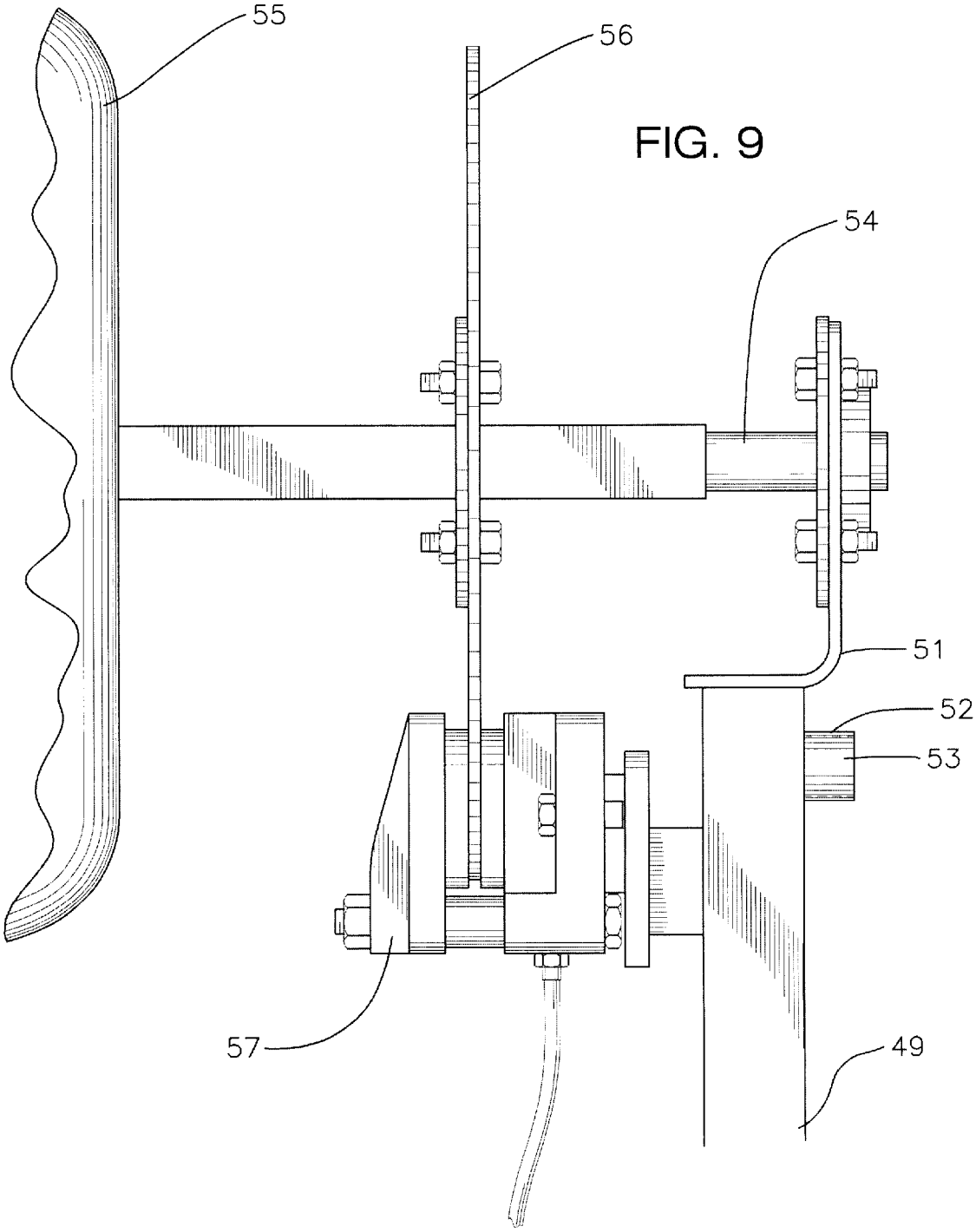
FIG. 9 is a schematic front view of the breaking means of the present invention.
Figure 10:
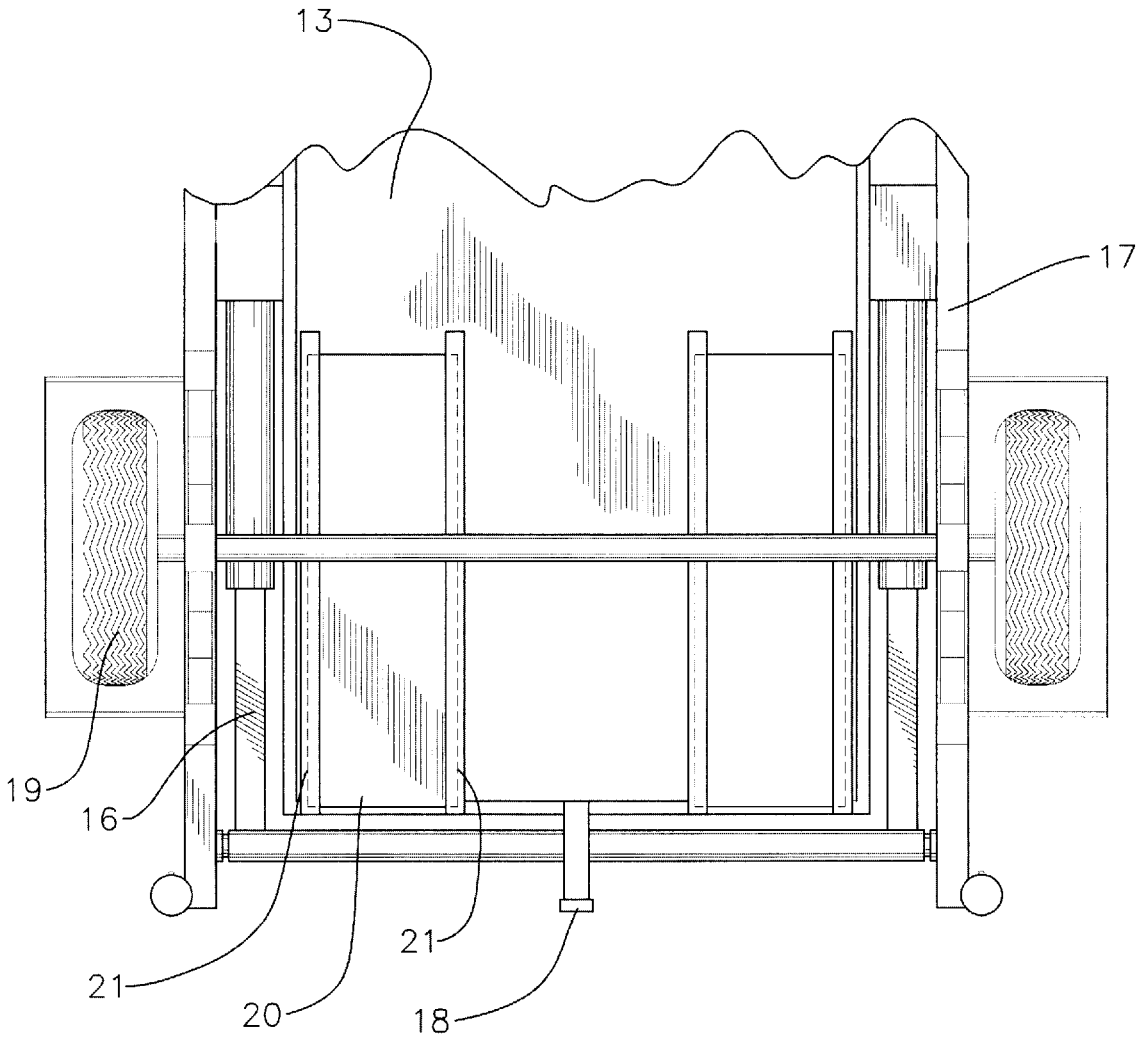
FIG. 10 is a schematic bottom view of the trailer of the present invention.
Figure 11:
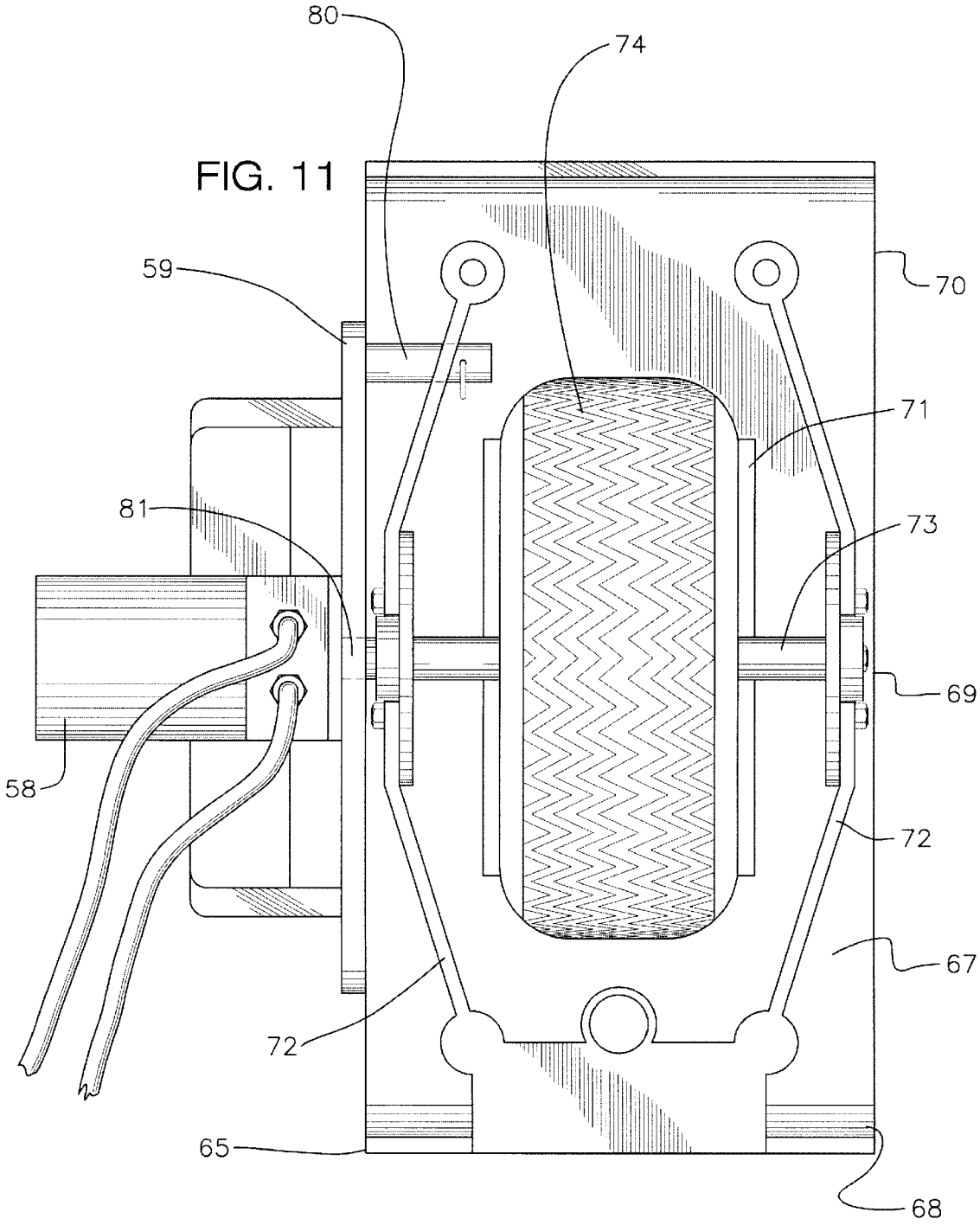
FIG. 11 is a schematic bottom view of the panel of the cable guiding means of the present invention.

In use, the apparatus 10 is used for laying cable 6, such as fiber optic cable, which cannot be easily spliced for re-routing under roadways and such. A user first uses the support arms 31 to pick up the spool 5. This is done by moving the support arms 31 away from the trailer 11 and placing the second ends 33 of the support arms under the elongate pole 28 which is inserted through the spool. The first 38 and second 41 actuators then lift the spool onto the trailer. The spool may be transported in this way as well. When a user of the apparatus 10 comes across a roadway, it is necessary to unwind the entire spool of cable to get to the end to run it under the roadway. The user does this by placing the elongate member 60 in the mounting 64 on the back end of the trailer 11. The cable 6 is positioned into the guide members 79, between the tire portions 74, 78 and placed in the slits in the cylinder 90 and extension member 94. The inner sleeve 95 is rotated to close the slit in the extension member 94. The motor 58 is positioned on the wall 72 so that it may engage the arm 73 to turn the first wheel portion 74. The motor 58 is turned on and the tire portions begin to extract the cable 6 by pulling it off of the spool 5. The elongate member 60 is moved back and forth to allow the cable to fall upon the ground in the shape of a figure-8 so that it does not tangle. The wheels 55 are placed against the outer discs as shown in FIG. 3 and the breaking means 57 is used to slow the spool if it should turn too fast. When all of the cable 6 is off of the spool, it is returned to the spool by running the cable through the cable guiding means and back on the spool. The motor is attached to the first axle 54 and the spool is rotated using the wheels 55. The operator moves the cable guide member back and forth to evenly distribute the cable onto the spool.

The breaking means 57 also serves the dual purpose of creating tension in the cable while the cable is being laid. This useful when the cable is being position on telephone poles and the like where the cable must have tension to keep it off of the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A winding and unwinding apparatus for winding cable on a spool, said spool comprising a middle section and a pair of outer discs, said apparatus comprising:

a trailer, said trailer having a top surface, a bottom surface, a front end, a back end a pair of lateral sides;

a power supply, said power supply being securely attached to a top surface of said trailer;

an elongate pole for extending through said spool;

a pair of support arms, each of said support arms having a first end and a second end, each of said first ends being rotatably coupled to one of said lateral sides, each of said second ends comprising a clamp adapted to removably and rotatably couple to said pole;

a first actuator, said first actuator comprising an elongate actuator having a first end and a second end, said first actuator being adapted to selectively vary the length between said first and second ends of said first actuator, said first end of said first actuator being pivotally coupled to said a first of said lateral sides, said second end of said first actuator being pivotally coupled to a first of said support arms, said first actuator being mechanically coupled to said power supply;

a driving means for controlling rotation of said spool;

a cable guiding means for guiding the cable on and off of said spool, said cable guiding means being removably mounted to said back end of said trailer; and a control means for controlling said power supply, said control means being operationally coupled to said power supply, said first actuators, and said driving means.

2. The winding and unwinding apparatus as in claim 1, wherein said trailer further comprises:

said front end comprising a male hitch portion, said back end having a female hitch portion coupled thereto, each of a pair of wheels being rotatably coupled to one of said lateral sides, each of a pair of ramps being movably positioned on guide rails securely attached to said bottom surface of said trailer, said guide rails being orientated generally parallel with said lateral sides and positioned generally adjacent to said back end.

3. The winding and unwinding apparatus as in claim 2, further comprising:

a pair of stabilizing legs, each of said stabilizing legs being coupled to a free end of one of said lateral sides, each of said stabilizing legs being selectively extendable in a vertical direction.

4. The winding and unwinding apparatus as in claim 1, wherein said power supply comprises:

said power supply being securely attached to said top surface and positioned generally adjacent to said front end, said power supply comprising a hydraulic pump.

5. The winding and unwinding apparatus as in claim 4, further comprising:

said hydraulic pump being fluidly coupled to a tank adapted for holding oil, said tank being located generally adjacent to said power supply and being securely attached to said top surface, said tank having a temperature gauge thereon, said tank having a volume gauge thereon.

6. The winding and unwinding apparatus as in claim 1, further comprising:

a pair of securing members, each of said securing members comprising a cylinder movably positionable on said elongate pole, each of said cylinders having a wall integrally coupled thereto and radially extending away therefrom for placement against said spool, each of said securing members being selectively securable to said elongate pole, wherein said pole is extended through said spool and each of said securing members is secured to said pole on an opposite side of said spool.

7. The winding and unwinding apparatus as in claim 1, wherein said support arms comprise:

each of said arms being telescoping arms such that a length between said first and second ends of each of said arms may be selectively varied.

8. The winding and unwinding apparatus as in claim 1, further comprising:

a second actuator, said second actuator comprising an elongate actuator having a first end and a second end, said second actuator being adapted to selectively vary the length between said first and second ends of said second actuator, said first end of said second actuator being pivotally coupled to said a second of said lateral sides, said second end of said second actuator being pivotally coupled to a second of said support arms pivotally coupled to said second lateral side, said second actuator being mechanically coupled to said power supply.

9. The winding and unwinding apparatus as in claim 8, wherein said first actuator comprises a hydraulic actuator and said second actuator comprises a hydraulic actuator.

10. The winding and unwinding apparatus as in claim 1, wherein said driving means comprises:

a first axle, said first axle extending between and being rotatably coupled to said lateral sides, said first axle being positioned generally between said front end and said support arms;

an actuating member, said actuating member comprising an elongate actuator having a first end and a second end, said actuating member being adapted to selectively vary the length between said first and second ends of said actuating, member, said first end of said actuating member being pivotally coupled to said top surface of said trailer, said second end of said actuating member being pivotally coupled to an upright member integrally coupled to said first axle, said actuating member being mechanically coupled to said power supply;

a pair of bars, each of said bars being elongate and having a first end and a second end, said first ends being integrally coupled to said first axle and extending away from said axle in a parallel direction, each of said bars being located generally adjacent to one of said lateral sides;

a protruding member, said protruding member being integrally coupled to a first of said bars and being positioned generally adjacent to said second end of said first arm, said protruding member having a hole extending therein;

a second axle, said second axle extending between and being rotatably coupled to said second ends of said bars;

a pair of wheels, each of said wheels being removably mounted on said second axle and being positioned between said bars; and a motor, said motor being securely coupled to a plate, said plate having a rod extending therefrom, said rod being removably extendable in said protruding member, said plate having a hole therethrough for removably receiving an end of said second axle, wherein said motor is adapted to rotate said second axle, said motor being mechanically coupled to said power supply.

11. The winding and unwinding apparatus as in claim 10, wherein said comprises a hydraulic motor adapted for selectively rotating said second axle forward or backward.

12. The winding and unwinding apparatus as in claim 10, further comprising:

a disc portion, said disc portion being securely mounted on said second axle such that said second axle extends through an axis of said disc portion, said disc portion being located generally adjacent to said first bar;

a braking means for frictionally engaging said disc portion, said braking means being securely coupled to said first bar, said braking means being mechanically coupled to said power supply.

13. The winding and unwinding apparatus as in claim 10, wherein said cable guiding means comprises:

an elongate member, said elongate member having a first end and a second end, said elongate member having a bend therein located generally adjacent to said first end;

a mounting member for receiving said first end of said elongate member, said mounting member being coupled to and extending upwardly from said back end of said trailer;

a panel, said panel being substantially rigid, said panel having a top side and a bottom side, said panel having a distal portion, a middle portion and a proximal portion, said second end of said elongate member being removably coupled to said bottom side of said distal portion of said panel, said panel having a slot therethrough positioned in a middle portion of said panel;

a pair of walls extending downwardly from and being integrally coupled to said bottom side of said panel, each of said walls being positioned on an opposite side of said slot;

an arm extending between and being rotatably coupled to said walls, said arm extending through and being securely attached to a first tire portion such that a perimeter of said first tire portion extends upwardly through said slot, one of said walls having a hole therethrough for receiving said rod coupled to said plate such that said motor may removably engage said arm;

a vertically extending implement being integrally coupled and extending upwardly from said top side of said panel;

a bracket being movably positioned on said vertically extending implement;

a second tire portion being rotatably coupled to said bracket such that said second tire may be selectively positioned nearer or further away from said panel; and a cylinder, said cylinder being securely attached to said top side of said proximal portion and extending away therefrom, said cylinder having a pair of ends, said cylinder having a peripheral wall having a slit therein, said slit extending between said ends of said cylinder.

14. The winding and unwinding apparatus as in claim 13, further comprising:

an extension member, said extension member comprising a outer sleeve and an inner sleeve, said inner sleeve being positioned in said outer sleeve, each of said sleeves bein, substantially rigid, each of said sleeves having a generally cylindrical shape, said inner sleeve being, rotatable with respect to said outer sleeve, each of said sleeves having an elongate slit extending between their respective ends, said extension member being positionable in said cylinder.

15. The winding and unwinding apparatus as in claim 1, wherein said cable guiding means comprises:

an elongate member, said elongate member having a first end and a second end, said elongate member having a bend therein located generally adjacent to said first end;

a mounting member for receiving said first end of said elongate member, said mounting member being coupled to and extending upwardly from said back end of said trailer;

a panel, said panel being substantially rigid, said panel having a top side and a bottom side, said panel having a distal portion, a middle portion and a proximal portion, said second end of said elongate member being removably coupled to said bottom side of said distal portion of said panel, said panel having a slot therethrough positioned in a middle portion of said panel;

a pair of walls extending downwardly from and being integrally coupled to said bottom side of said panel, each of said walls being positioned on an opposite side of said slot;

an arm extending between and being rotatably coupled to said walls, said arm extending through and being securely attached to a first tire portion such that a perimeter of said first tire portion extends upwardly through said slot, a motor, said motor being securely coupled to a plate, said plate having a rod extending therefrom, said plate having a hole therethrough for removably receiving an end of said arm, wherein said motor is adapted to rotate said arm, said motor being mechanically coupled to said power supply;

one of said walls having a hole therethrough for receiving said rod coupled to said plate such that said motor may removably engage said arm;

a vertically extending implement being integrally coupled and extending upwardly from said top side of said panel;

a bracket being movably positioned on said vertically extending implement;

a second tire portion being rotatably coupled to said bracket such that said second tire may be selectively positioned nearer or further away from said panel; and a cylinder, said cylinder being securely attached to said top side of said proximal portion and extending away therefrom, said cylinder having a pair of ends, said cylinder having a peripheral wall having a slit therein, said slit extending between said ends of said cylinder.

16. The winding and unwinding apparatus as in claim 15, further comprising:

a pair of guide members for guiding said cable between said first and second tire portions, each of said guide members being positioned on opposite sides of said second tire portion, each of said guide members comprising a pair of upstanding members.

17. The winding and unwinding apparatus as in claim 15, further comprising:

an extension member, said extension member comprising a outer sleeve and an inner sleeve, said inner sleeve being positioned in said outer sleeve, each of said sleeves being substantially rigid, each of said sleeves having a generally cylindrical shape, said inner sleeve being rotatable with respect to said outer sleeve, each of said sleeves having an elongate slit extending between their respective ends, said extension member being positionable in said cylinder.

18. A winding and unwinding apparatus for winding cable on a spool, said spool comprising a middle section and a pair of outer discs, said apparatus comprising:

a trailer, said trailer having a top surface, a bottom surface, a front end, a back end, a first lateral side and a second lateral side, said front end comprising a male hitch portion;

a power supply, said power supply being securely attached to said top surface and positioned generally adjacent to said front end, said power supply comprising a hydraulic pump;

an elongate pole for extending through said spool;

a pair of support arms, each of said support arms having a first end and a second end, each of said first ends being rotatably coupled to one of said lateral sides and positioned generally adjacent to said back end, each of said second ends comprising a clamp, each of said clamps being adapted to removably couple to said pole such that said pole is rotatably coupled to each of said support arms, each of said arms being telescoping arms such that a length between said first and second ends of each of said arms may be selectively varied;

a first actuator, said first actuator comprising an elongate actuator having a first end and a second end, said first actuator being adapted to selectively vary the length between said first and second ends of said first actuator, said first end of said first actuator being pivotally coupled to said first lateral side and positioned generally between said front and back ends, said second end of said first actuator being pivotally coupled to a first of said support arms pivotally coupled to said first lateral side, said first actuator being mechanically coupled to said power supply, said first actuator comprising a hydraulic actuator;

a second actuator, said second actuator comprising an elongate actuator having a first end and a second end, said second actuator being adapted to selectively vary the length between said first and second ends of said second actuator, said first end of said second actuator being pivotally coupled to said second lateral side and positioned generally between said front and back ends, said second end of said second actuator being pivotally coupled to a second of said support arms pivotally coupled to said second lateral side, said second actuator being mechanically coupled to said power supply, said second actuator comprising a hydraulic actuator;

a driving means for controlling rotation of said spool;

a cable guiding means for guiding the cable on and off of said spool, said cable guiding means comprising;

an elongate member, said elongate member having a first end and a second end, said elongate member having a bend therein located generally adjacent to said first end;

a mounting member for receiving said first end of said elongate member, said mounting member being coupled to and extending upwardly from said back end of said trailer, said mounting member having a well extending therein, wherein said first end of said elongate member is extendable into said well such that said elongate member is rotatable with respect to said trailer portion;

a panel, said panel being substantially rigid, said panel having a top side and a bottom side, said panel having a distal portion, a middle portion and a proximal portion, said second end of said elongate member being removably coupled to said bottom side of said distal portion of said panel, said panel having a slot therethrough positioned in a middle portion of said panel;

a pair of walls extending downwardly from and being integrally coupled to said bottom side of said panel, each of said walls being positioned on an opposite side of said slot;

an arm extending between and being rotatably coupled to said walls, said arm extending through and being securely attached to a first tire portion such that a perimeter of said first tire portion extends upwardly through said slot;

a motor being removably coupled to said arm and adapted to rotate said arm, said motor being operationally coupled to said power supply;

a vertically extending implement being integrally coupled and extending upwardly from said top side of said panel;

a bracket being movably positioned on said vertically extending implement;

a second tire portion being rotatably coupled to said bracket such that said second tire may be selectively positioned nearer or further away from said panel;

a cylinder, said cylinder being securely attached to said top side of said proximal portion and extending away therefrom, said cylinder having a pair of ends, said cylinder having a peripheral wall having a slit therein, said slit extending between said ends of said cylinder;

an extension member, said extension member comprising a outer sleeve and an inner sleeve, said inner sleeve being positioned in said outer sleeve, each of said sleeves being substantially rigid, each of said sleeves having a generally cylindrical shape, said inner sleeve being rotatable with respect to said outer sleeve, each of said sleeves having an elongate slit extending between their respective ends, said extension member being positionable in said cylinder; and a control means for controlling said power supply, said control means being operationally coupled to said power supply, said first and second actuators, and said motor, said control means being securely attached to said trailer.

19. A winding and unwinding apparatus for winding cable on a spool, said spool comprising a middle section and a pair of outer discs, said apparatus comprising:

a trailer, said trailer having a top surface, a bottom surface, a front end, a back end, a first lateral side and a second lateral side, said front end comprising a male hitch portion, said back end having a female hitch portion coupled thereto, each of a pair of wheels being rotatably coupled to one of said lateral sides, each of a pair of ramps being movably positioned on guide rails securely attached to said bottom surface of said trailer, said guide rails being orientated generally parallel with said lateral sides and positioned generally adjacent to said back end;

a pair of stabilizing legs, each of said stabilizing legs being coupled to a free end of one of said lateral sides, each of said stabilizing legs being selectively extendable in a vertical direction;

a power supply, said power supply being securely attached to said top surface and positioned generally adjacent to said front end, said power supply comprising a hydraulic pump, said hydraulic pump being fluidly coupled to a tank adapted for holding oil, said tank being located generally adjacent to said power supply and being securely attached to said top surface, said tank having a temperature gauge thereon, said tank having a volume gauge thereon;

an elongate pole for extending through said spool;

a pair of securing members, each of said securing members comprising a cylinder movably positionable on said elongate pole, each of said cylinders having a wall integrally coupled thereto and radially extending away therefrom for placement against said spool, each of said securing members being selectively securable to said elongate pole, wherein said pole is extended through said spool and each of said securing members is secured to said pole on an opposite side of said spool;

a pair of support arms, each of said support arms having a first end and a second end, each of said first ends being rotatably coupled to one of said lateral sides and positioned generally adjacent to said back end, each of said second ends comprising a clamp, each of said clamps being adapted to removably couple to said pole such that said pole is rotatably coupled to each of said support arms, each of said arms being telescoping arms such that a length between said first and second ends of each of said arms may be selectively varied;

a first actuator, said first actuator comprising an elongate actuator having a first end and a second end, said first actuator being adapted to selectively vary the length between said first and second ends of said first actuator, said first end of said first actuator being pivotally coupled to said first lateral side and positioned generally between said front and back ends, said second end of said first actuator being pivotally coupled to a first of said support arms pivotally coupled to said first lateral side, said first actuator being mechanically coupled to said power supply, said first actuator comprising a hydraulic actuator;

a second actuator, said second actuator comprising an elongate actuator having a first end and a second end, said second actuator being adapted to selectively vary the length between said first and second ends of said second actuator, said first end of said second actuator being pivotally coupled to said second lateral side and positioned generally between said front and back ends, said second end of said second actuator being pivotally coupled to a second of said support arms pivotally coupled to said second lateral side, said second actuator being mechanically coupled to said power supply, said second actuator comprising a hydraulic actuator;

a driving means for controlling rotation of said spool, said driving means comprising;

a first axle, said first axle extending between and being rotatably coupled to said lateral sides, said first axle being positioned generally between said front end and said support arms;

an actuating member, said actuating member comprising an elongate actuator having a first end and a second end, said actuating member being adapted to selectively vary the length between said first and second ends of said actuating member, said first end of said actuating member being pivotally coupled to said top surface of said trailer, said second end of said actuating member being pivotally coupled to an upright member integrally coupled to said first axle, said actuating member being mechanically coupled to said power supply;

a pair of bars, each of said bars being elongate and having a first end and a second end, said first ends being integrally coupled to said first axle and extending away from said axle in a parallel direction, each of said bars being located generally adjacent to one of said lateral sides;

a protruding member, said protruding member being integrally coupled to a first of said bars and being positioned generally adjacent to said second end of said first arm, said protruding member having a hole extending therein;

a second axle, said second axle extending between and being rotatably coupled to said second ends of said bars;

a pair of wheels, each of said wheels being removably mounted on said second axle and being positioned between said bars;

a disc portion, said disc portion being securely mounted on said second axle such that said second axle extends through an axis of said disc portion, said disc portion being located generally adjacent to said first bar;

a braking means for frictionally engaging said disc portion, said braking means being securely coupled to said first bar, said braking means being mechanically coupled to said power supply, said braking means comprising a hydraulic brake;

a motor, said motor being securely coupled to a plate, said plate having a rod extending therefrom, said rod being removably extendable in said protruding member, said plate having a hole therethrough for removably receiving an end of said second axle, wherein said motor is adapted to rotate said second axle, said motor being mechanically coupled to said power supply, said motor comprising a hydraulic motor adapted for selectively rotating said second axle forward or backward;

a cable guiding means for guiding the cable on and off of said spool, said cable guiding means comprising;

an elongate member, said elongate member having a first end and a second end, said elongate member having a bend therein located generally adjacent to said first end, said bend defining an angle generally between 135 degrees and 170 degrees;

a mounting member for receiving said first end of said elongate member, said mounting member being coupled to and extending upwardly from said back end of said trailer, said mounting member having a well extending therein, wherein said first end of said elongate member is extendable into said well such that said elongate member is rotatable with respect to said trailer portion;

a panel, said panel being substantially rigid, said panel having a top side and a bottom side, said panel having a distal portion, a middle portion and a proximal portion, said second end of said elongate member being removably coupled to said bottom side of said distal portion of said panel, said panel having a slot therethrough positioned in a middle portion of said panel;

a pair of walls extending downwardly from and being integrally coupled to said bottom side of said panel, each of said walls being positioned on an opposite side of said slot;

an arm extending between and being rotatably coupled to said walls, said arm extending through and being securely attached to a first tire portion such that a perimeter of said first tire portion extends upwardly through said slot, one of said walls having a hole therethrough for receiving said rod coupled to said plate such that said motor may engage said arm;

a vertically extending implement being integrally coupled and extending upwardly from said top side of said panel;

a bracket being movably positioned on said vertically extending implement;

a second tire portion being rotatably coupled to said bracket such that said second tire may be selectively positioned nearer or further away from said panel;

a pair of guide members for guiding said cable between said first and second tire portions, each of said guide members being positioned on opposite sides of said second tire portion, each of said guide members comprising a pair of upstanding members;

a cylinder, said cylinder being securely attached to said top side of said proximal portion and extending away therefrom, said cylinder having a pair of ends, said cylinder having a peripheral wall having a slit therein, said slit extending between said ends of said cylinder;

an extension member, said extension member comprising a outer sleeve and an inner sleeve, said inner sleeve being positioned in said outer sleeve, each of said sleeves being substantially rigid, each of said sleeves having a generally cylindrical shape, said inner sleeve being rotatable with respect to said outer sleeve, each of said sleeves having an elongate slit extending between their respective ends, said extension member being positionable in said cylinder; and a control means for controlling said power supply, said control means being operationally coupled to said power supply, said first and second actuators, said actuating member, said breaking means and said motor, said control means being securely attached to said trailer.

* * * * *